US006932035B1

(12) United States Patent
Shui et al.

(10) Patent No.: US 6,932,035 B1
(45) Date of Patent: Aug. 23, 2005

(54) CYLINDER VALVE OPERATING SYSTEM FOR INTERNAL COMBUSTION ENGINE

(75) Inventors: Fang Shui, Farmington Hills, MI (US); Kim Ku, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/905,975

(22) Filed: Jan. 28, 2005

(51) Int. Cl.[7] ..... F01L 1/34
(52) U.S. Cl. ..... 123/90.16; 123/90.15; 123/90.39
(58) Field of Search ..... 123/90.16, 90.25, 123/90.24, 90.39, 90.41, 90.44

(56) References Cited

U.S. PATENT DOCUMENTS

| | | | | |
|---|---|---|---|---|
| 5,078,102 | A | 1/1992 | Matsumoto | |
| 5,373,818 | A | 12/1994 | Unger | |
| 5,988,125 | A | 11/1999 | Hara et al. | |
| 5,996,540 | A | 12/1999 | Hara | |
| 6,019,076 | A | 2/2000 | Pierik et al. | |
| 6,041,746 | A | 3/2000 | Takemura et al. | |
| 6,318,317 | B1 | 11/2001 | Hubschle | |
| 6,354,255 | B1 | 3/2002 | Methley et al. | |
| 6,360,705 | B1 | 3/2002 | Raghavan et al. | |
| 6,378,474 | B1 | 4/2002 | Pierik | |
| 6,425,357 | B2 * | 7/2002 | Shimizu et al. | 123/90.16 |
| 6,491,008 | B1 * | 12/2002 | Zubeck | 123/90.16 |

FOREIGN PATENT DOCUMENTS

| | | |
|---|---|---|
| EP | 0717174 | 6/1996 |
| EP | 0780547 | 6/1997 |
| WO | WO 9836157 | 8/1998 |

OTHER PUBLICATIONS

BMW Press Release:"BMW Four-Cylinder Petrol Engine with Valvetronic"; Author Unk.; Feb., 2001.

* cited by examiner

*Primary Examiner*—Thomas Denion
*Assistant Examiner*—Zelalem Eshete
(74) *Attorney, Agent, or Firm*—Diana D. Brehob; Dykema Gossett PLLC

(57) ABSTRACT

A poppet valve operating system for an internal combustion engine includes a finger follower which is driven by an intermediate rocker. The intermediate rocker selectively converts motion imparted by a drive cam into either a purely translational trajectory, or into a mixed translational and rotational trajectory, so as to open a poppet valve which is ultimately actuated by a finger follower interposed between the intermediate rocker and the valve.

10 Claims, 4 Drawing Sheets

CYLINDER VALVE OPERATING SYSTEM FOR INTERNAL COMBUSTION ENGINE

BACKGROUND OF THE INVENTION

1. Field of the Invention

The present invention relates to a system for operating poppet-type cylinder valves of a reciprocating internal combustion engine, so as to selectively control the duration of the valve opening events.

2. Disclosure Information

Variable valve duration control devices have been the subject of much invention during the past few decades. U.S. Pat. No. 5,373,818 discloses but one example of such inventive activity. The '818 patent describes a variable duration valve operating system having at least one embodiment which is useful with bucket tappets, but which is not useful for application to roller finger followers. A second embodiment may be employed with a finger follower, but in the context of an operating system having high inertia, and therefore, unacceptably slow system response time.

Other types of variable valve operating devices have been used, including such systems as axially shiftable camshafts, cam timing control devices, electromagnetically actuated valves, and yet other devices. The present system is readily usable with finger follower valve actuation systems and allows the control of valve events extending from no valve opening whatsoever (i.e., valve deactivation) to a maximum opening.

SUMMARY OF THE INVENTION

A poppet valve operating system for an internal combustion engine includes a poppet valve, a finger follower for actuating the poppet valve, and an intermediate rocker for actuating a finger follower. The intermediate rocker has a control surface formed therein. A drive cam, powered by a crankshaft of the engine, actuates the intermediate rocker by providing input force tending to move the intermediate rocker translationally. A selectively positioned control roller which bears upon the control surface of the intermediate rocker controls the lift of the poppet valve by selectively causing the motion of the intermediate rocker to be at least partially rotational. The control roller is positionable such that the intermediate rocker has a range of movement extending from purely translational movement, which does not cause the finger follower to lift the poppet valve, to a range of mixed translational and rotational trajectories causing the finger follower to lift the poppet valve to varying degrees. The finger follower has a first end contacting the poppet valve, and a second end operatively connected with a hydraulic lash adjuster extending between a cylinder head of the engine and the second end of the finger follower.

According to another aspect of the present invention, a method for operating a poppet cylinder valve in an internal combustion engine includes the steps of providing a drive cam powered by a crankshaft to the engine, providing an intermediate rocker actuated by the drive cam, and providing a finger follower for actuating a poppet valve, with the finger follower being actuated by the intermediate rocker. Finally, the present method includes the step of providing a control roller for interacting with a control surface incorporated as part of the intermediate rocker, so as to determine the lift of a poppet valve actuated by the finger follower by controlling the rotational movement of the intermediate rocker resulting from actuation of the intermediate rocker by the drive cam.

The previously described control roller has a number of operating positions including at least a first position in which the intermediate rocker moves purely translationally, and a second position, in which the intermediate rocker moves both translationally and rotationally.

The present valve operating system offers the advantage of lower operating inertia as compared with known designs, as well as smaller package volume. Further, the present system may be employed with roller finger follower technology.

Other advantages, as well as objects and features of the present invention, will become apparent to the reader of this specification.

DETAILED DESCRIPTION OF THE PREFERRED EMBODIMENTS

Figure 1:
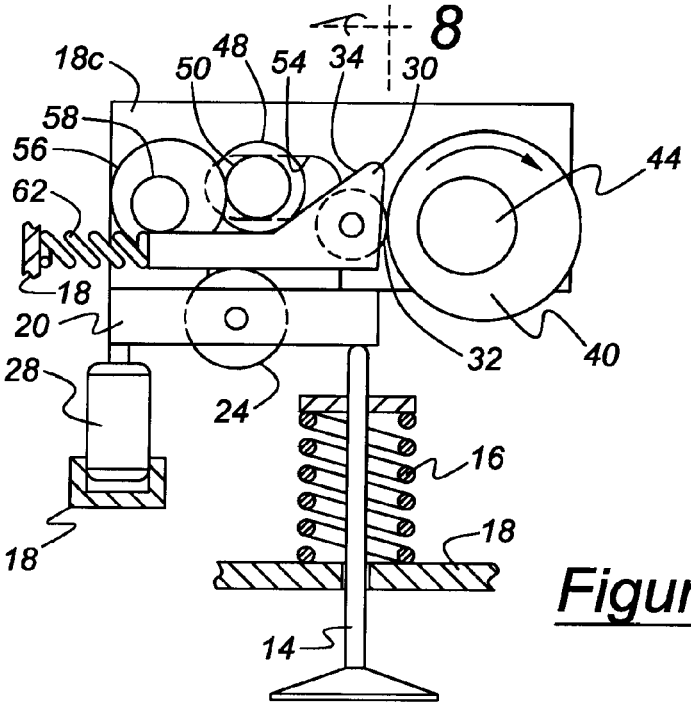
FIG. 1 is a side elevation of a cylinder valve operating system according to the present invention with the system's drive cam on its base circle.

As shown in various figures, the present cylinder valve operating system, 10, is intended for use with poppet valves 14, which are mounted within cylinder head 18 of an engine. Valves 14 are returned to their closed positions by means of valve springs 16. Each of valves 14 is actuated by means of a finger follower, 20, which has a first end in contact with valve 14 and a second end in contact with lash adjuster 28, which is mounted to cylinder head 18. Finger follower 20 has a roller, 24, which contacts intermediate rocker 30.

Intermediate rocker 30 is biased into contact with drive cam 40 by means of compression spring 62. Alternatively, a torsion spring (not shown) could be used for this purpose. Intermediate rocker 30 rotatably actuates finger follower 20 as drive cam 40, which is mounted upon camshaft 44, and driven either by a crankshaft or other rotating member of the engine (not shown), pushes upon rocker roller 32, thereby moving intermediate rocker 30 translationally. Camshaft 44 and intermediate rocker 30 are mounted so that the motion imparted by camshaft 44 and drive cam 40 to intermediate rocker 30 is purely translational. This translational movement is controllably transformed into rotational movement of intermediate rocker 30 by control roller 48, which is mounted upon support shaft 50. In essence, intermediate rocker 30 pivots about an instantaneous contact point existing between control surface 34 and the outer diametral surface of control shaft 58. Support shaft 50 is carried within control slot 54 formed in cylinder head 18*c*. Alternatively, support shaft 50 may be carried within a slotted member rigidly attached to cylinder head 18.

Control slot 54 permits translational movement of support shaft 50. This translational movement is produced by control cam 56 which is mounted upon control shaft 58. As control shaft 58 is rotated, control cam 56 displaces control shaft 50 within slot 54, so as to move control roller 48 to a new operating position. In general, when control roller 48 is moved closer to camshaft 44, valve lift will be increased because control roller 48 will be operating on rocker ramp 34, which is a control surface formed in intermediate rocker 30, in a position so that the motion depicted in FIGS. 3 and 6 will occur.

Figure 2:
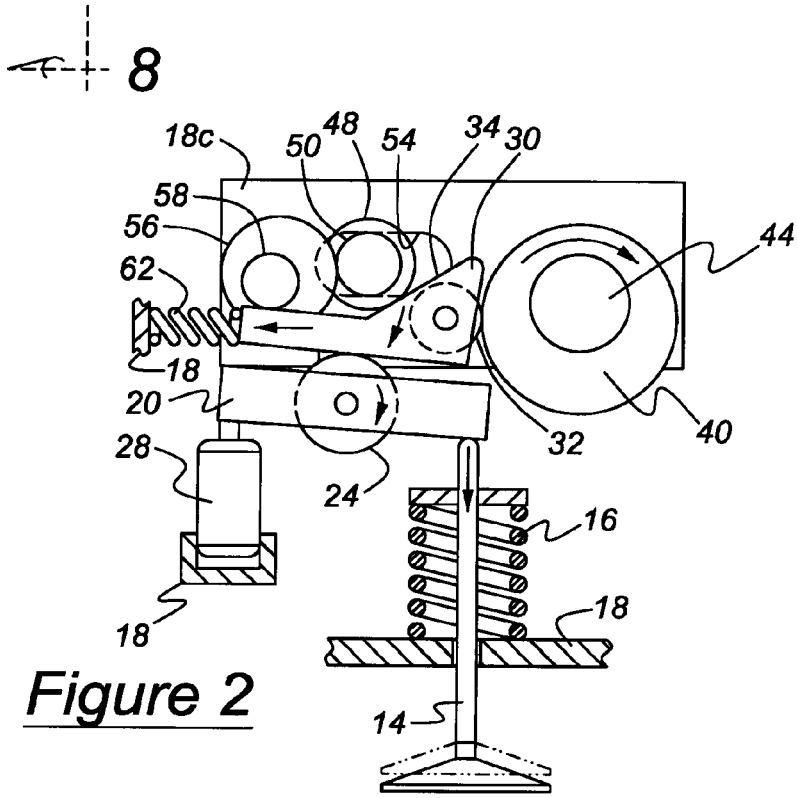
FIG. 2 shows the system of FIG. 1, but with the drive cam, 40, rotated 90 degrees from the midpoint of the cam's base circle.
Figure 3:
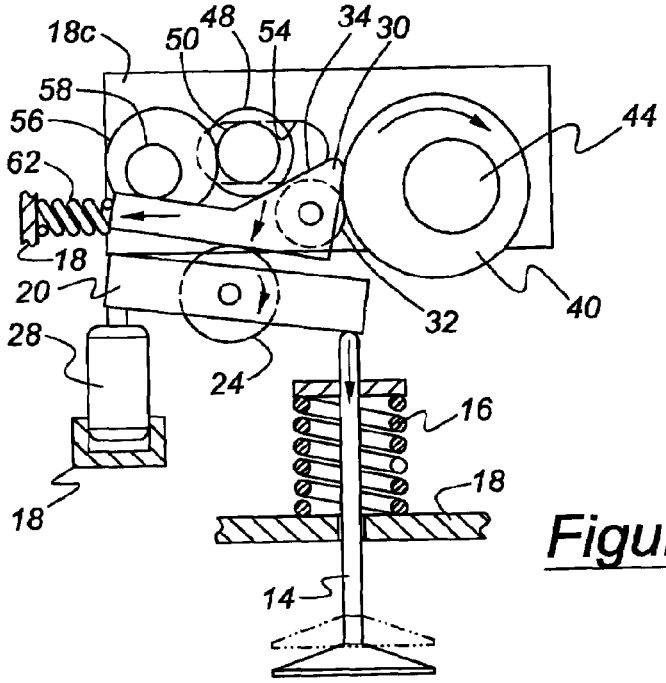
FIG. 3 is similar to FIGS. 1 and 2, but shows drive cam 40 rotated to its maximum lift position.
Figure 4:
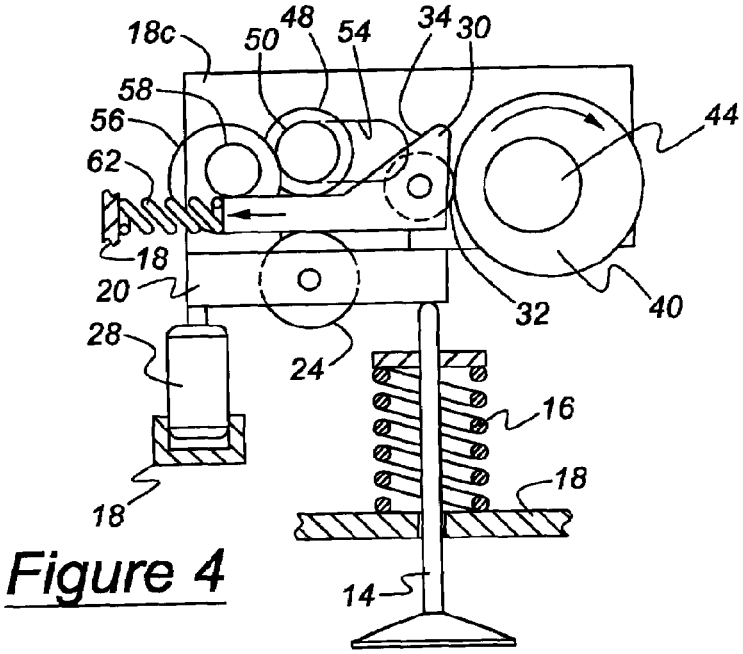
FIG. 4 illustrates the system of FIGS. 1–3, but in a lower valve lift position, and with drive cam 40 being in its base circle location.
Figure 5:
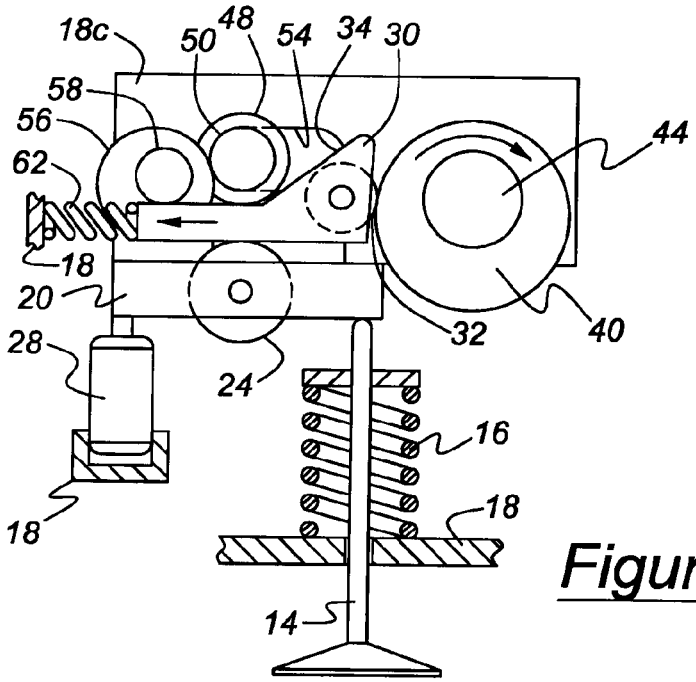
FIG. 5 illustrates the set-up of FIG. 4, but with drive cam 40 in an intermediate position.
Figure 6:
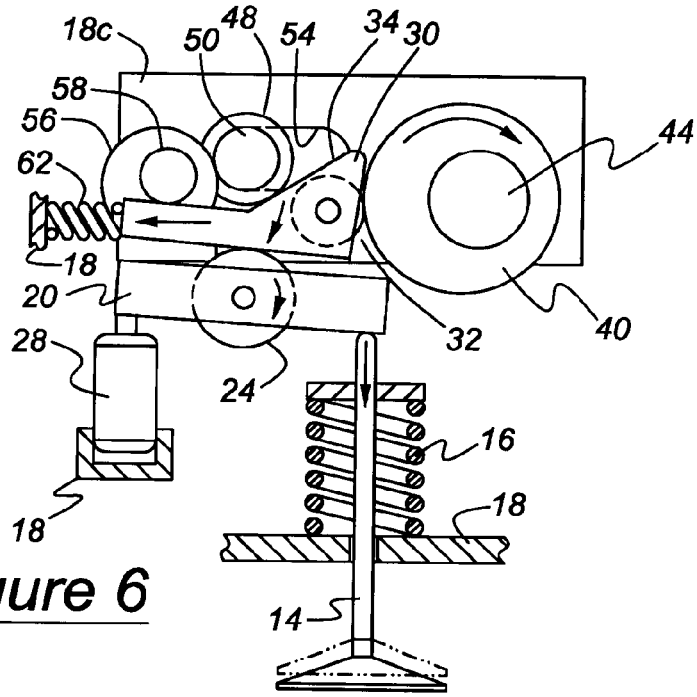
FIG. 6 illustrates the set-up of FIGS. 4–5, but with drive cam 40 in a maximum lift position.

FIGS. 1 and 4 show valve 14 in its closed position, with drive cam 40 on its based circle, or no lift, position. Thus, valve 14 is closed in FIGS. 1 and 4. However, in FIGS. 2 and 5, drive cam 40 has rotated to a mid-lift position and in FIG. 2, valve 14 has started to lift. Note however, that in FIG. 5, valve 14 has not begun to lift because control roller 48 is not bearing upon a portion of rocker ramp 34 wherein intermediate rocker 30 has started to move through a trajectory in which it not only translates as indicated, but also rotates as shown in FIG. 2, but not in FIG. 5. In FIGS. 3 and 6, drive cam 40 has rotated to its maximum lift position. It is noted however that the lift imparted to valve 14 is greater in FIG. 3 than that depicted in FIG. 6. This is easily understood by virtue of the positions shown for control roller 48 in FIGS. 3 and 6. Note that in FIG. 3, control roller 48 is much higher up on the ramp or control surface 34 of intermediate rocker 30.

Figure 7:
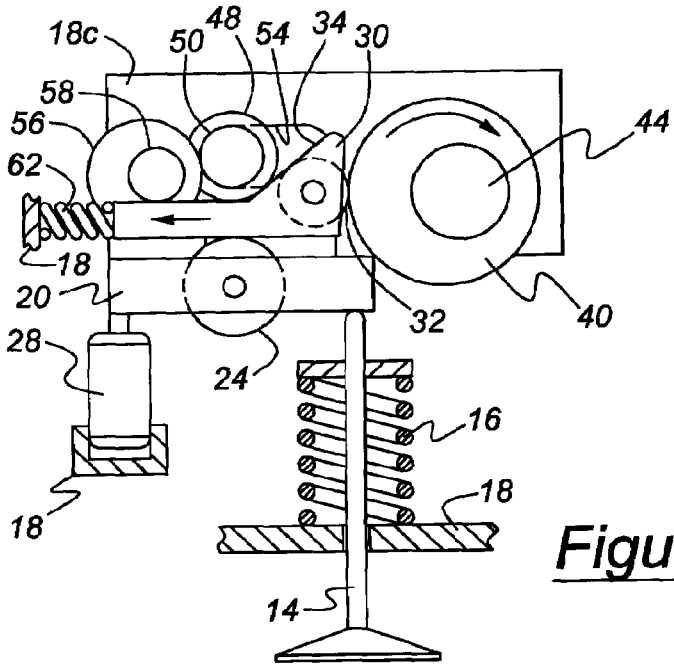
FIG. 7 illustrates the present system with drive cam 40 in a maximum lift position, but with the system producing no lift at valve 14.

In FIG. 7, the present system is at position of maximum lift of drive cam 40, but valve 14 remains closed because control roller 48 is on the base portion of rocker ramp 34 which simulates the base circle of a conventional rotating cam lobe. In other words, no lift occurs because notwithstanding that translational motion of intermediate rocker 30 has occurred and, to the same extent as it always occurs with this system, intermediate rocker has not been caused to rotate at all, with the result being that valve 14 remains closed. Accordingly, the present system may be employed to produce a full range of valve lifts extending from no lift whatsoever to a maximum lift value, depending upon the geometry of rocker ramp 34, as well as the lift available from drive cam 40.

Figure 8:
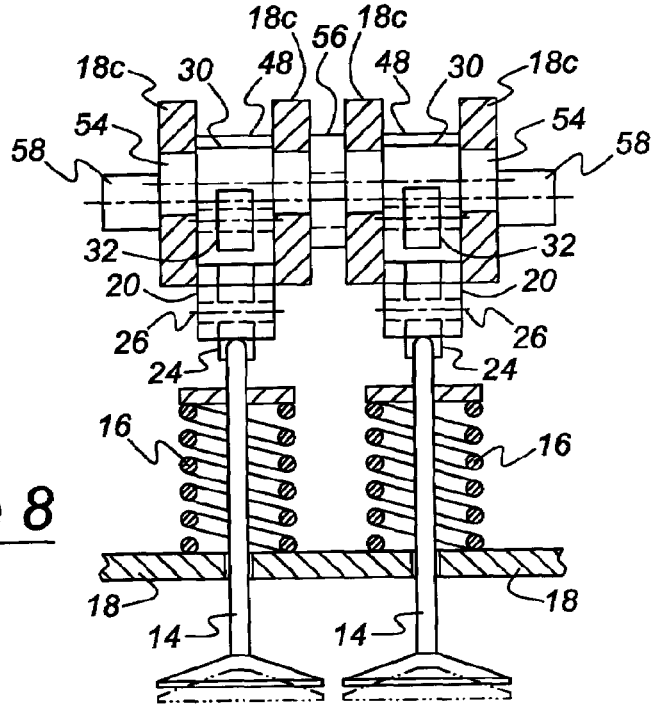
FIG. 8 is an elevational view of the present system, partially broken away, taken along the line of 8—8 of FIG. 1.

FIG. 8 shows the present system as driving multiple valves, 14, which could comprise either intake valves or exhaust valves. This view more clearly shows the spatial orientation of control shaft 58, intermediate rocker 30, and finger follower 20.

Although the present invention has been described in connection with particular embodiments thereof, it is to be understood that various modifications, alterations, and adaptations may be made by those skilled in the art without departing from the spirit and scope of the invention set forth in the following claims.

What is claimed is:

1. A poppet valve operating system for an internal combustion engine, comprising:

a poppet valve;

a finger follower for actuating said poppet valve;

an intermediate rocker for rotatably actuating said finger follower, with said intermediate rocker having a control surface formed therein;

a drive cam, powered by a crankshaft of said engine, for actuating said intermediate rocker; and a selectively positionable control roller, bearing upon said control surface of said intermediate rocker, so as to control the lift of said poppet valve by controlling the rotational motion of said intermediate rocker.

2. A poppet valve operating system according to claim 1, further comprising a control cam, mounted upon a rotatable control shaft, for positioning a support shaft upon which said control roller is mounted.

3. A poppet valve operating system according to claim 1, further comprising a control slot, formed in a structure which is rigidly mounted to a cylinder head of an engine, with said control slot sized to permit translational movement of said support shaft.

4. A poppet valve operating system according to claim 1, wherein said control roller has a plurality of operating positions, comprising at least first and second positions, with said intermediate rocker moving purely translationally when said control roller is in said first operating position, with the result that said poppet valve remains in a closed position, and with said intermediate rocker moving both translationally and rotationally when said control roller is in said second operating position, with the result that said poppet valve opens and then closes.

5. A poppet valve operating system according to claim 4, wherein said intermediate rocker pivots about an instantaneous contact point existing between said control surface and an outer diametral surface of said control shaft.

6. A poppet valve operating system according to claim 1, wherein said drive cam moves said intermediate rocker purely translationally.

7. A poppet valve operating system according to claim 1, wherein said drive cam moves said intermediate rocker both translationally and rotationally.

8. A method for operating a poppet cylinder valve in an internal combustion engine, comprising the steps of:

providing a drive cam powered by a crankshaft of said engine;

providing an intermediate rocker actuated by said drive cam;

providing a finger follower for actuating a poppet valve, with said finger follower being actuated by said intermediate rocker; and providing a control roller for interacting with a control surface incorporated in said intermediate rocker, so as to determine the lift of a poppet valve actuated by said finger follower, by controlling rotational movement of said intermediate rocker resulting from translational actuation of said intermediate rocker by said drive cam.

9. A poppet valve operating system for an internal combustion engine, comprising:

a poppet valve;

a finger follower for actuating said poppet valve;

an intermediate rocker for actuating said finger follower, with said intermediate rocker having a control surface formed therein;

a drive cam, powered by a crankshaft of said engine, for actuating said intermediate rocker by providing an input force which moves said intermediate rocker translationally; and a selectively positionable control roller which bears upon said control surface of said intermediate rocker, so as to control the lift of said poppet valve by selectively causing the motion of said intermediate rocker to be at least partly rotational, with said control roller being positionable such that said intermediate rocker has a range of movement extending from purely translational movement, which does not cause said finger follower to lift said poppet valve, to a range of mixed translational and rotational trajectories causing said finger follower to lift said poppet valve.

10. A poppet valve operating system according to claim 9, wherein said finger follower has a first end contacting said poppet valve, and a second end operatively connected with a hydraulic lash adjuster extending between a cylinder head of the engine and said second end.

* * * * *